US008397862B2

(12) United States Patent
Shand

(10) Patent No.: US 8,397,862 B2
(45) Date of Patent: Mar. 19, 2013

(54) SOUND AND FLASH SUPPRESSOR FOR FIREARMS

(76) Inventor: Ronnie Alexander Shand, Jupiter, FL (US)

( * ) Notice: Subject to any disclaimer, the term of this patent is extended or adjusted under 35 U.S.C. 154(b) by 0 days.

(21) Appl. No.: 13/196,851

(22) Filed: Aug. 2, 2011

(65) Prior Publication Data

US 2012/0080261 A1 Apr. 5, 2012

Related U.S. Application Data

(60) Provisional application No. 61/370,455, filed on Aug. 4, 2010.

(51) Int. Cl.
*F41A 21/30* (2006.01)

(52) U.S. Cl. ..... 181/223; 89/14.3; 89/14.4

(58) Field of Classification Search ..... 181/223; 89/14.3, 14.4
See application file for complete search history.

(56) References Cited

U.S. PATENT DOCUMENTS 5,398,589 A * 3/1995 Kazyaka et al. ..... 89/14.4

* cited by examiner

*Primary Examiner* — Jeremy Luks
(74) *Attorney, Agent, or Firm* — Smith Moore Leatherwood LLP; Thomas W. Epting

(57) ABSTRACT

A gun suppressor having a single or multiple vacuum chambers that create a vacuum enclosed volume for gases to expand into. Accordingly, the pressure of the gas that exits the suppressor is reduced significantly; therefore, the sound of the gun firing is more silent than conventional silencers. Prior to firing the gun, a vacuum seal is placed at the exit orifice of the suppressor and a vacuum is created inside of the suppressor with the use of a vacuum pump. The vacuum chamber reduces the pressure wave caused at the end of the firearm's barrel. When the firearm is discharged, the gases fill the vacuum chamber instead of exiting at normal atmospheric pressure level. As the bullet continues its travel through the end of the suppressor, it perforates the vacuum seal and continues its flight path.

10 Claims, 10 Drawing Sheets

SOUND AND FLASH SUPPRESSOR FOR FIREARMS

CROSS-REFERENCE TO RELATED APPLICATIONS

This application is a continuation of Ser. No. 61/370,455 filed on Aug. 4, 2010, by the same inventor Ronnie Alexander Shand.

BACKGROUND

1. Field of the Invention

The present invention relates to a sound and flash suppressor for a firearm, and more particularly to reduce the noise caused by the firing of a firearm comprising a silencer muffler which attenuates explosive sounds generated by firearms and which have a straight-through passage for the projectile and silencing chambers for the explosive exhaust.

2. Background of the Invention

Sound suppressors for firearms are well known in the prior art, and many have been patented over a hundred years.

Many different techniques have been created and patented, chambers, gas passages and baffles of varying designs have been extensively used. The purpose of a sound and flash suppressor, regardless of the technique used, is to reduce the exit pressure and velocity of the propellant gases from the firearm's barrel so that the resulting sound level and flash is significantly reduced.

In addition, most prior art firearm suppressors do not significantly reduce muzzle flash. Also, some prior suppressor inventions require many different internal parts that are difficult to assemble and require constant replacement.

U.S. Pat. No. 3,385,164 (Walther et al) discloses the use of conical baffles that includes a plurality of shoulders on the interior surface of a conical baffle. Also disclosed is the use of these annular shoulders on the exterior and interior surfaces of a conical baffle. However, the use of these shoulders with annular shoulders was used together with other methods and these conical baffles were located only in the area of the exit of the bullet from the suppressor.

U.S. Pat. No. 6,575,074 (Gaddini) features several baffles that have an integral reduced diameter coaxial spacers that are vented in a specific manner, dependent upon the caliber of the firearm in use.

U.S. Pat. No. 4,588,043 (Finn) and U.S. Pat. No. 5,164,535 (Leasure) are indicative of the complex baffles that use slanted sidewalls or asymmetric cuts into the bore of the baffles.

International Publication Number WO 99/39147 (Lapwood et al) discloses a gun silencer that compromises of a single baffle free gas expansion chamber. This single chamber is easier to maintain and to clean.

REFERENCES CITED

| U.S. Pat. Documents | | |
|---|---|---|
| 916,885 | March 1909 | Maxim |
| 385,164 | May 1968 | Hubner et al. |
| 3,748,956 | July 1973 | Hubner |
| 4,291,610 | September 1981 | Waiser |
| 4,576,083 | March 1986 | Seberger, Jr. |
| 4,907,488 | March 1990 | Seberger |
| 5,029,512 | July 1991 | Latka |

-continued

| U.S. Pat. Documents | | |
|---|---|---|
| 5,136,923 | August 1992 | Walsh |
| 5,164,535 | November 1992 | Leasure |
| 5,679,916 | October 1997 | Weichert |
| 6,575,074 B1 | June 2003 | Gaddini |
| 7,207,258 B1 | April 2007 | Scanlon |
| 7,237,467 B1 | July 2007 | Melton |
| 7,302,774 B2 | December 2007 | Meyers |
| 7,308,967 B1 | December 2007 | Hoel |
| 7,587,969 B2 | September 2009 | Silvers |
| 7,594,464 | September 2009 | Dueck |

| Foreign Patent Documents | | |
|---|---|---|
| WO 99/39147 | August 1999 | WO |
| WO 00/57122 | September 2000 | WO |
| GB 2425823 A | November 2006 | GB |

SUMMARY

The present invention is a firearm suppressor that uses a vacuum chamber that reduces the sound and flash levels that are typically created when a firearm is discharged. The vacuum chamber of the present invention has adds a novel feature to firearm suppressors that enables the propellant gases to fill the vacuum chamber and by this way to remain inside the suppressor for a longer period of time. The principal object of the present invention is that the vacuum chamber diminishes the volume of gases that exit the muzzle of the firearm caused by discharging the firearm. Another objective of the present invention is to reduce flash at the muzzle. Another objective of the present invention is to reduce the pressure wave caused at the end of the firearm's barrel.

A representative embodiment of my invention is provided for a firearm that has a barrel for guiding the bullet, ammunition, a combustion chamber, a barrel for guiding the projectile a suppressor, and a vacuum generator.

In one embodiment, the present invention is a suppressor that includes a proximal end and a distal end, the proximal end is configured for mounting the suppressor to the firearm's barrel, the distal end is configured to receive a vacuum seal and to allow the bullet to exit the suppressor along its flight path, and the at least one vacuum chamber disposed between the proximal and distal end of the suppressor. A vacuum generator or vacuum pump connects to the suppressor in order the generate vacuum within the interior cavities of the suppressor.

The distal end of the suppressor has an end cap to seal the exit hole of the suppressor and allow vacuum to be formed. The ammunition when loaded into the chamber of the barrel forms a seal at this location to allow a vacuum chamber to be created inside the barrel all the way to the distal end of the suppressor.

When the firearm is discharged the bullet travels through the barrel followed by high pressure gases. Once the bullet reaches the interior chamber of the suppressor, the gases will start to fill the vacuum chamber instead of finding a volume of air at a normal atmospheric pressure level. As the bullet continues its travel through the distal end of the suppressor, it will perforate the vacuum seal and continue its flight path.

After a single shot, the vacuum seal is destroyed and a new seal must be positioned at the distal end of the suppressor. Once a new round of ammunition is loaded into the firing chamber of the firearm's barrel and a new seal is placed in the distal end of the suppressor, the vacuum generator or pump can be used to remove most of the air from inside the suppressor and barrel and prepare the firearm for the next use.

In another embodiment of the present invention a multiple vacuum chamber suppressor is described.

In another embodiment of the present invention different types of vacuum seals are described to show that the vacuum seal can have any shape as long as it provides a good vacuum seal and at the same time it can be perforated with ease by the exiting bullet.

Additional advantages and novel features of my invention will be set forth in part in the detailed description of the drawings as follows, and will become apparent to those skilled in the art upon examination of my invention. It should be understood, however, that the detailed descriptions, while indicating a preferred embodiments of my invention, are given to illustrate the use of vacuum in my invention. Also the drawings and descriptions of the embodiments are to be regarded as illustrative only and not as restrictive method of making my invention.

DETAILED DESCRIPTION

Figure 1:
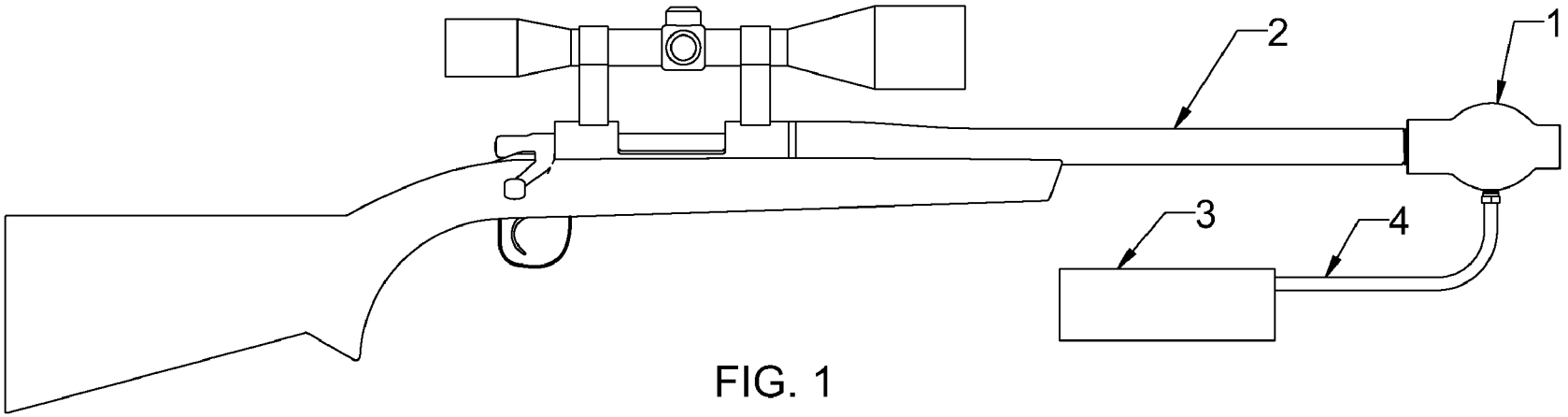
FIG. 1 is a side view of an embodiment of a firearm that includes an embodiment of the present invention.

Embodiments of firearm suppressors for reducing the muzzle blast and muzzle flash are described. While my invention is susceptible of several variations and modifications, it should be clear that there is no intention to limit the invention to the specific forms disclosed in the drawings, but on the contrary, my invention is to cover any modifications, variations, alternative constructions, and equivalent methods of using vacuum falling within the spirit and scope of my invention.

Referring now to FIG. 1, an embodiment of a rifle is shown to which an embodiment of a suppressor 1 is attached to the barrel 2. A portable vacuum generator 3 or vacuum pump 3 is connected to the suppressor 1 by a suction tube 4. Although a rifle type of firearm is shown on FIG. 1, embodiments of my invention may be used with other types of weapons such as cannons or hand guns. Although the vacuum pump 3 is shown as a separate component from the suppressor 1, it can also be constructed as an integral component of the suppressor 1.

Figure 2:
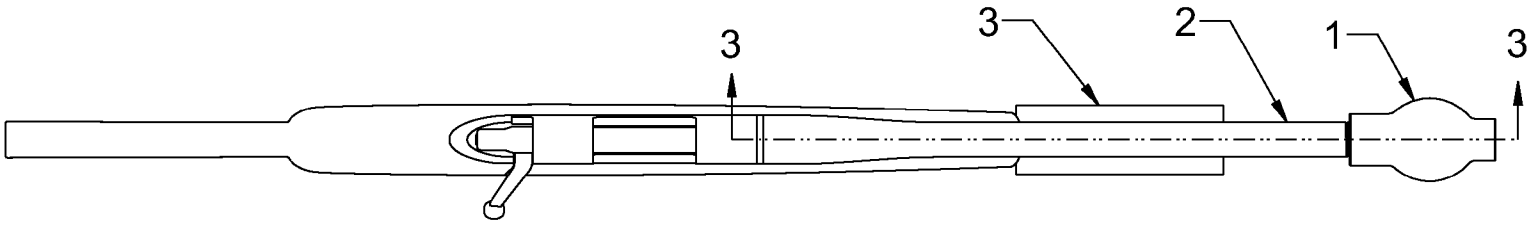
FIG. 2 is a top view of an embodiment of a firearm to show the projection arrows 3-3 of the cross section shown in FIG. 3.
Figure 3:
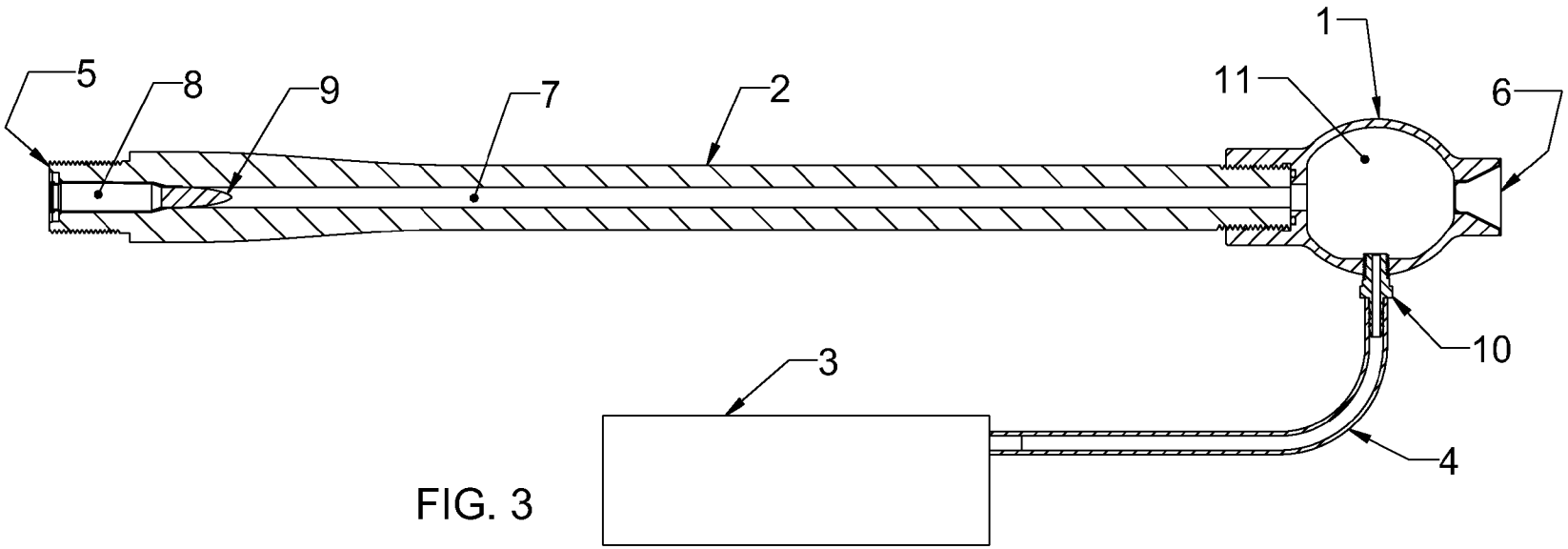
FIG. 3 is a sectional side view of an embodiment of a firearm's barrel, a firearm's ammunition and the suppressor of the present invention.

FIG. 2 is a top view of the firearm that shows the cross sectional line 3-3 used in the cross section view of FIG. 3.

FIG. 3 is a partial cross-sectional view taken along the line 3-3 of FIG. 2. A round of ammunition 8 is shown loaded into the proximal end 5 of the barrel 2. The ammunition 8 forms an air tight seal at the proximal end 5 of the barrel 2. The suppressor 1 is shown attached to the distal end of the firearm barrel 2. As shown the suppressor includes a distal end 6 including a discharging vacuum chamber 11. The vacuum pump 3 creates a volume of space inside the chamber 11 and inside the firearm's barrel 2 chamber 7 that becomes essentially empty of matter, such that its gaseous pressure is much less than the surrounding atmospheric pressure. A fitting 10 is shown attached to the lower portion of the suppressor's chamber 11. A vacuum suction tube 4 is connected between the fitting 10 and the vacuum pump 3.

Figure 4:
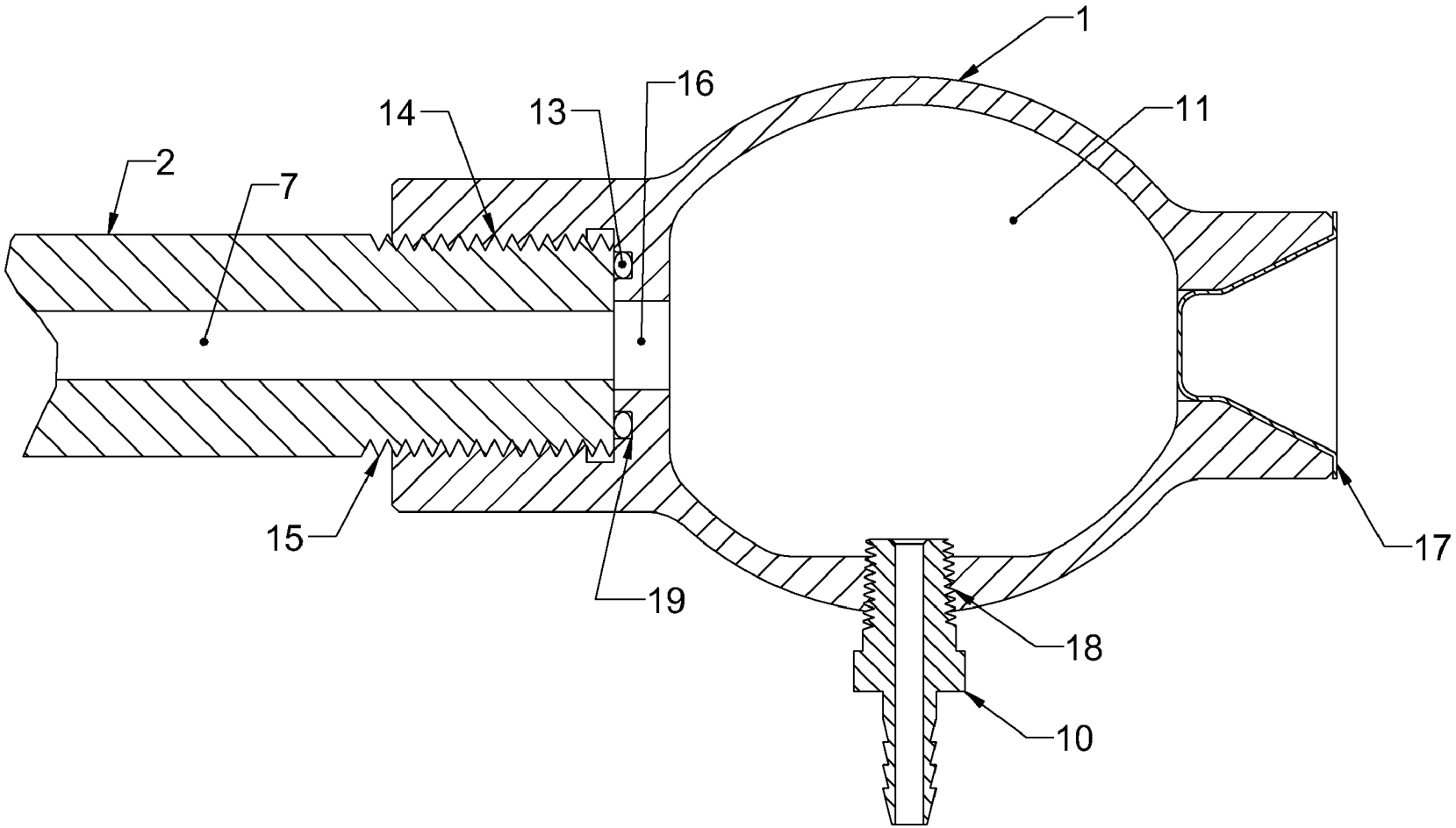
FIG. 4 is an enlargement sectional view of a the suppressor of the present invention.

FIG. 4 is an enlarge view of the suppressor 1 when connected to the distal end of the firearm barrel 2. The proximal end of the suppressor 1 has threads 14 that are used to connect to the threads 15 of the barrel 2. An o-ring 13 is shown in an o-ring groove 19 in order to create a vacuum seal at this location. The interior cavity 7 of the gun barrel 2 is shown without the riflings for clarity in all the views. The interior cavity 7 is shown aligned with the proximal end 16 of the suppressor 1. The vacuum seal 17 is shown installed at the distal end of the suppressor 1. A vacuum hose fitting 10 is shown installed in the port 18 of the suppressor 1.

Figure 5:
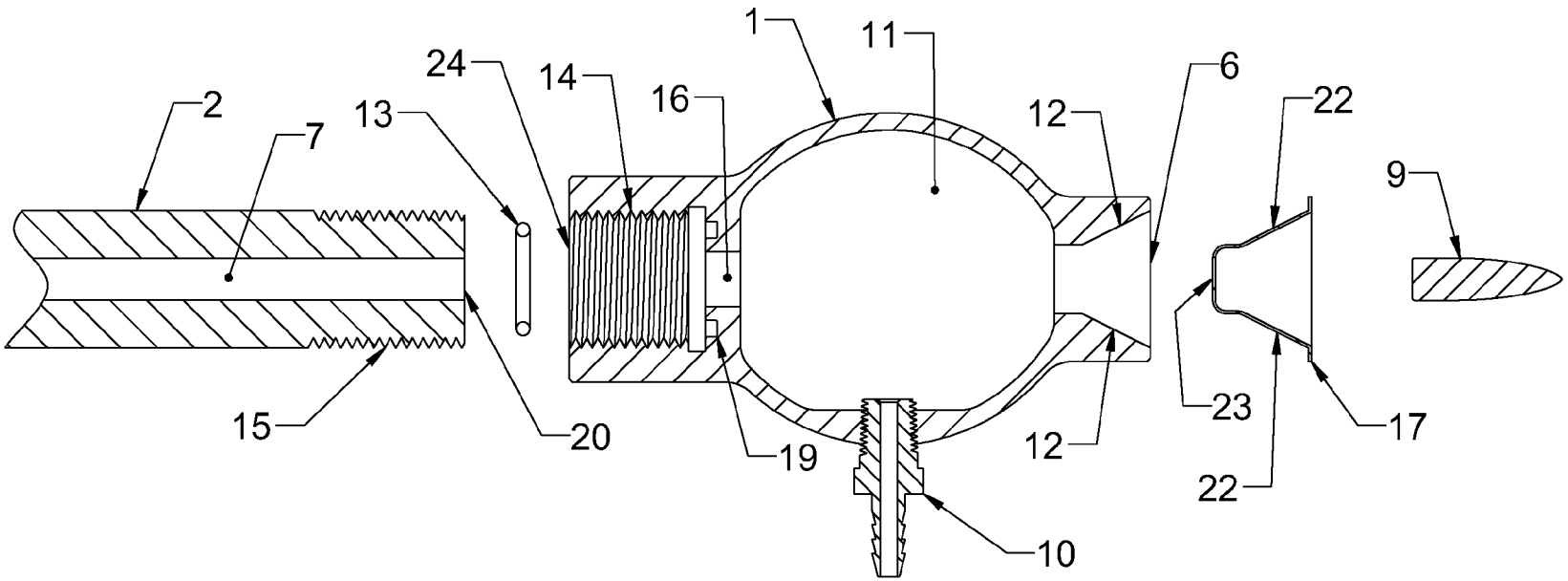
FIG. 5 is an exploded cross sectional view of FIG. 4.

FIG. 5 is an exploded view of FIG. 4. The distal end 20 of the barrel 2 form a seal with o-ring 13 and the o-ring groove 19. Threads 15 of barrel 2 engage threads 14 of the proximal end of the suppressor 1. When vacuum is generated inside the chamber 11, the distal surface 12 of the suppressor 1 become in contact with surface 22 of the vacuum seal 17 and the two surfaces form a good vacuum seal. The bullet 9 is shown as it exits distal end 6 of the suppressor 1. The bullet 9 travels through the interior 7 of the barrel 2, it reaches the vacuum chamber 11 of suppressor 1; then the bullet 9 perforates the vacuum seal 17 at the location 23 and continues its fight path to the target. The high pressure gases that follows the bullet 9, encounters a vacuum chamber prior to exiting the suppressor 1. After the shot is fired the vacuum seal 17 is destroyed and a new vacuum seal 17 is required.

Figure 6:
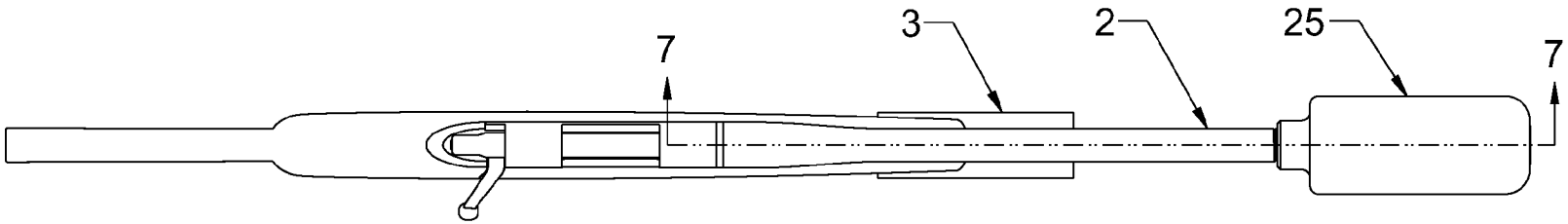
FIG. 6 is a top view of an embodiment of a firearm to show the projection arrows 7-7 of the cross section shown in FIG. 7.
Figure 7:
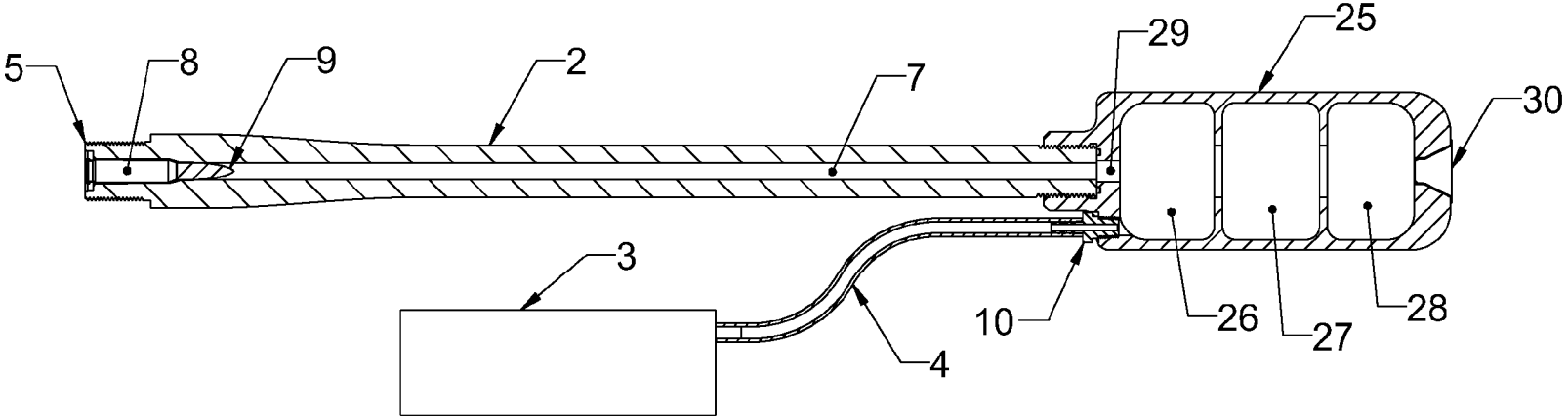
FIG. 7 is a side sectional view of the second preferred embodiment of the present invention.

FIG. 6 is a top view of the firearm that shows the cross sectional line 7-7 used in the cross section view of FIG. 7.

FIG. 7 depicts another embodiment of a suppressor 25 attached to the distal end of the firearm barrel 2. FIG. 7 is a partial cross-sectional view taken along the line 7-7 of FIG. 6. A round of ammunition 8 is shown loaded into the proximal end 5 of the barrel 2. The ammunition 8 forms an air tight seal at the proximal end 5 of the barrel 2. As shown, the suppressor includes a distal end 30 including three discharging vacuum chambers 26, 27, and 28. The vacuum pump 3 creates a volume of space inside the chambers 26, 27, and 28 and inside the firearm's barrel's chamber 7 that becomes essentially empty of matter, such that its gaseous pressure is much less than the surrounding atmospheric pressure. A fitting 10 is shown attached to the lower proximal end of the suppressor 25. A vacuum suction tube 4 is connected between the fitting 10 and the vacuum pump 3. Passage 29 connects the distal end of the barrel 2 with the suppressor 25.

Figure 8:
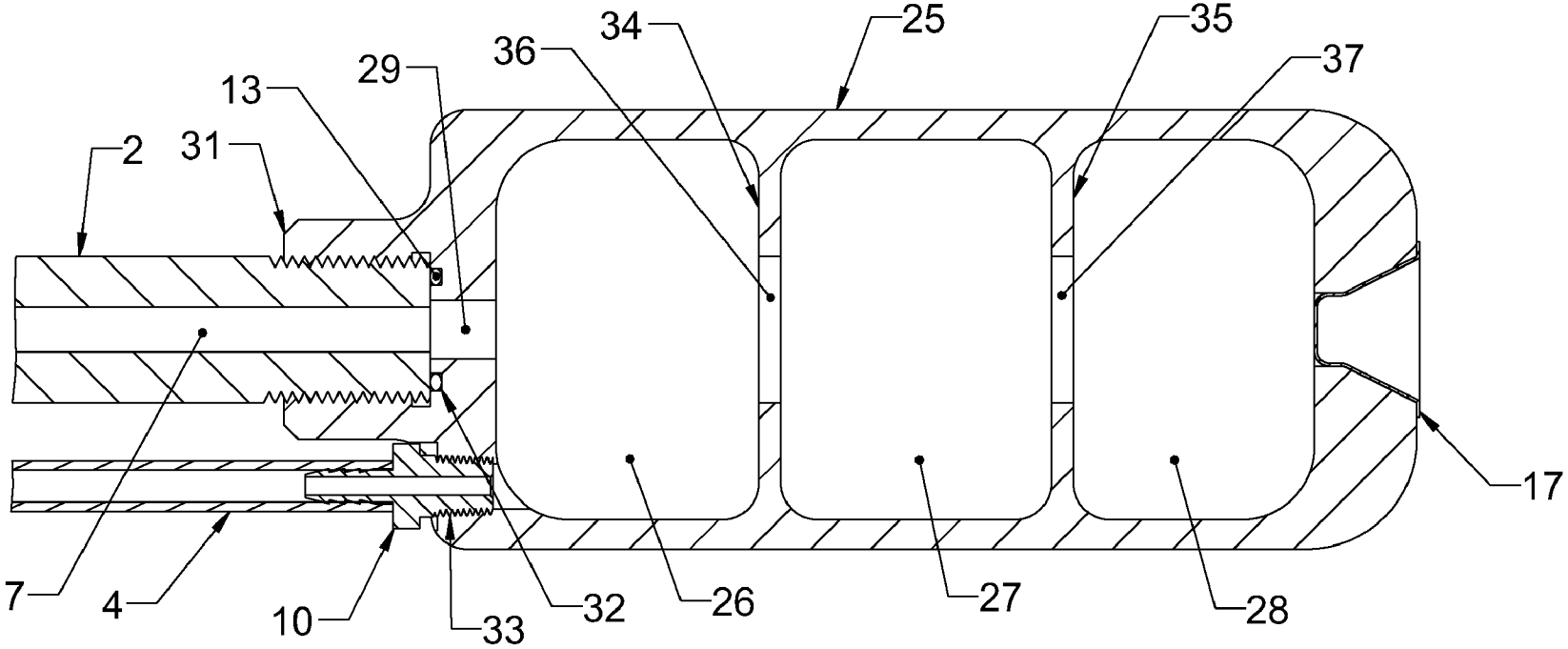
FIG. 8 is an enlargement sectional view of a the suppressor of the second preferred embodiment shown on FIG. 7.

FIG. 8 is an enlarge view of the suppressor 25 when connected to the distal end of the firearm barrel 2. The proximal end 31 of the suppressor 25 connects to the distal end of the barrel 2. An o-ring 13 is shown in an o-ring groove 32 in order to create a vacuum seal at this location. The interior cavity 7 is shown aligned with the proximal end passage 29 of the suppressor 25. The vacuum seal 17 is shown installed at the distal end of the suppressor 25 to create a vacuum seal at this location. Two inner ribs 34 and 35 are show in between chambers 26, 27, and 28. The purpose of ribs 34 and 35 are to strengthen the outer walls of the suppressor when high vacuum is applied to the inner chambers 26, 27, and 28. Two passages 36 and 37 connect the inner chambers 26, 27, and 28 of the suppressor 25.

Figure 9:
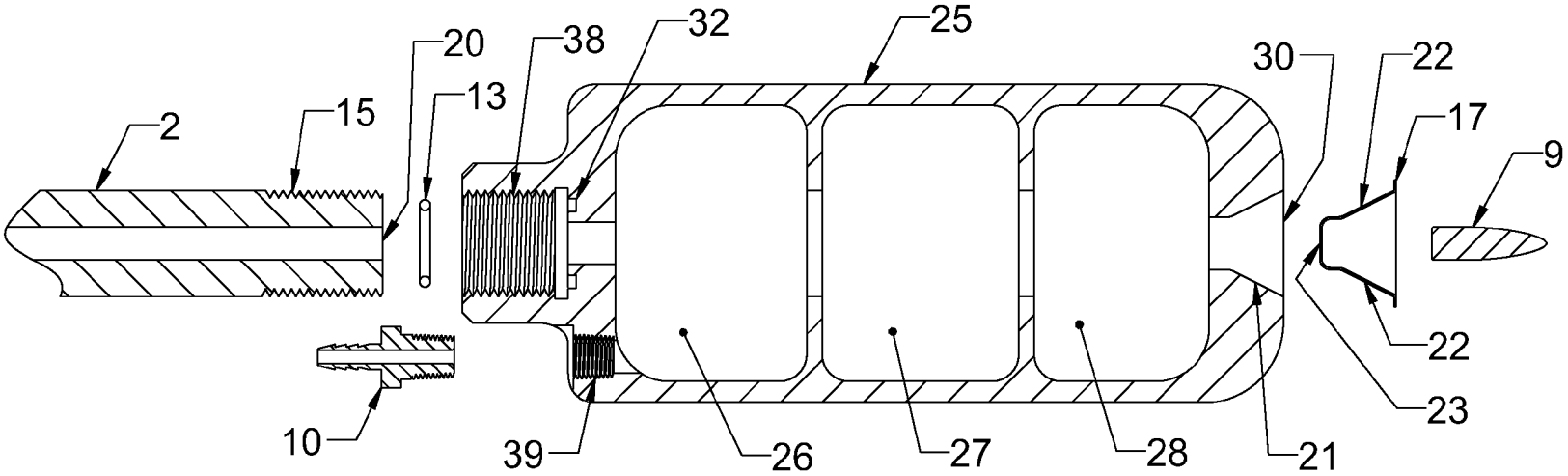
FIG. 9 is an exploded cross sectional view of FIG. 8.

FIG. 9 is an exploded view of FIG. 8. The distal end 20 of the barrel 2 form a seal with o-ring 13 and the o-ring groove 32. Threads 15 of barrel 2 engage threads 38 of the proximal end of the suppressor 25. When vacuum is generated inside the chambers 26, 27, and 28, the distal surface 21 of the suppressor 25 become in contact with surface 22 of the vacuum seal 17 and the two surfaces form a good vacuum seal. The bullet 9 is shown as it exits distal end 30 of the suppressor 25. The bullet 9 travels through the interior of the barrel 2, it reaches the vacuum chambers 26, 27, and 28 of the suppressor 25; then the bullet 9 perforates the vacuum seal 17 at the location 23 and continues its fight path to the target. After the shot is fired the vacuum seal 17 is destroyed and a new vacuum seal 17 is required.

Figure 10:
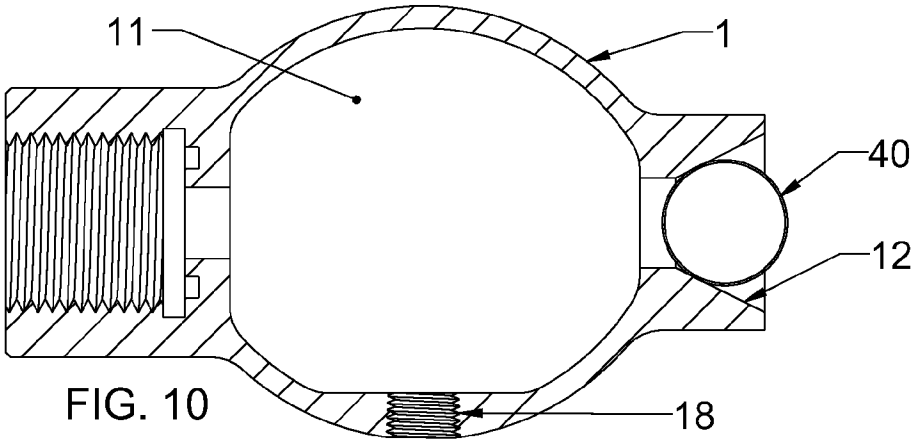
FIG. 10 is a sectional view of the preferred embodiment to show a second method for sealing the distal end of the suppressor vacuum chamber.

FIG. 10 depicts another method of sealing the distal end 12 of the embodiment of a suppressor 1 in order to create an enclosed vacuum chamber 11 when vacuum is generated. When the vacuum pump suctions the air out the chamber 11 through port 18, the front spherical seal 40 becomes in tight contact with the distal surface 12 of the suppressor 1. These drawings and descriptions of the embodiments are to be regarded as illustrative only and not as restrictive method of making a vacuum seal for the distal end of my invention.

Figure 11:
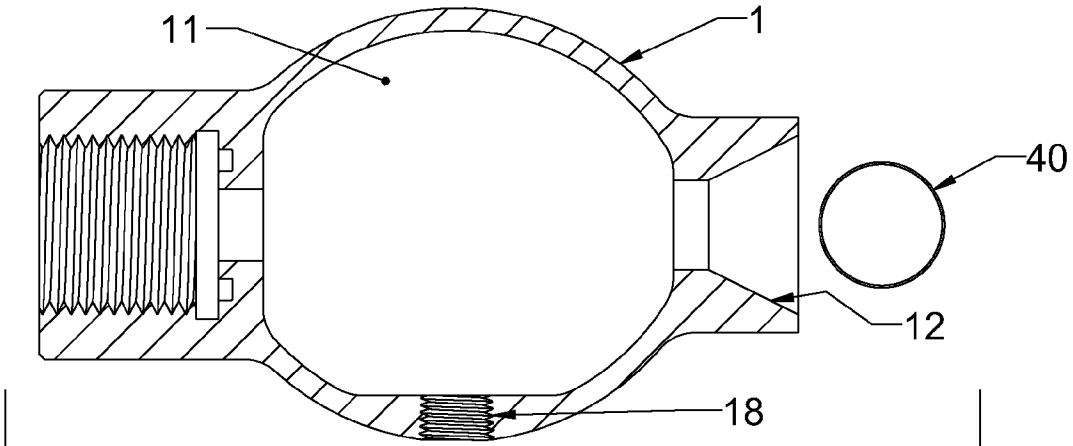
FIG. 11 is an exploded cross sectional view of FIG. 10.

FIG. 11 is an exploded view of FIG. 10. The spherical vacuum seal 40 is shown away from the distal mating surface 12 of the suppressor 1.

Figure 12:
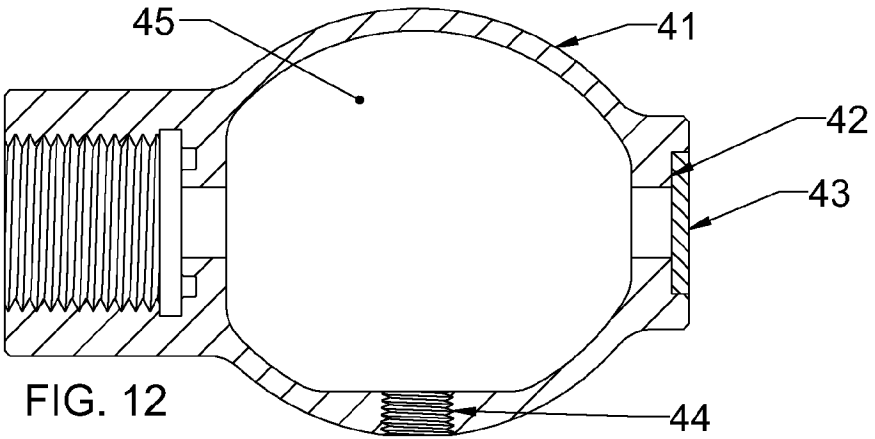
FIG. 12 is a sectional view of another embodiment to show an alternate method for sealing the distal end of the suppressor vacuum chamber.

FIG. 12 depicts another method of sealing the distal end 42 of another embodiment of a suppressor 41 in order to create an enclosed vacuum chamber 45 when vacuum is applied at port 44. When the vacuum pump suctions the air out the chamber 45 through port 44, the front seal 43 becomes in tight contact with the distal surface 42 of the suppressor 41. These drawings and descriptions of the embodiments are to be regarded as illustrative only and not as restrictive method of making a vacuum seal for the distal end of my invention.

Figure 13:
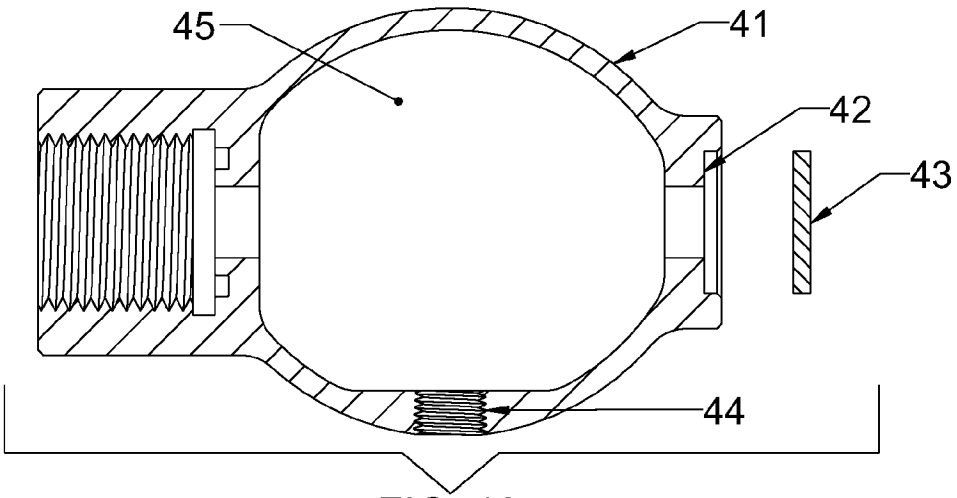
FIG. 13 is an exploded cross sectional view of FIG. 12.

FIG. 13 is an exploded view of FIG. 12. The vacuum seal 43 is shown away from the distal mating surface 42 of the suppressor 41.

Figure 14:
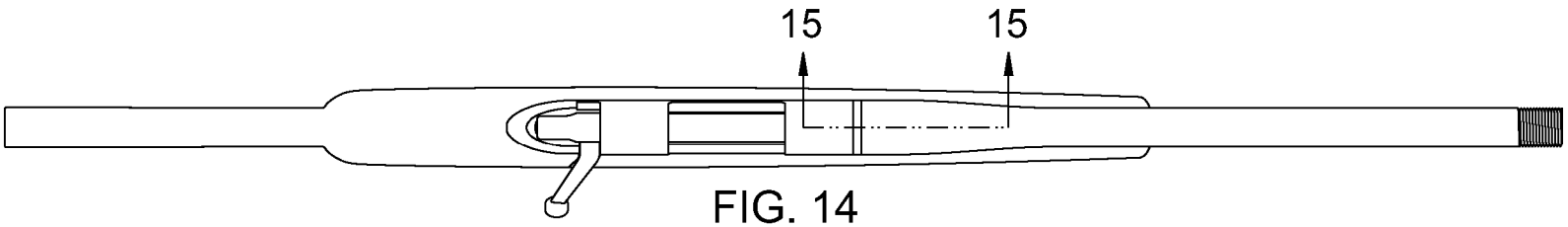
FIG. 14 is a top view of an embodiment of a firearm to show the projection arrows 15-15 of the cross section shown in FIG. 15.
Figure 15:
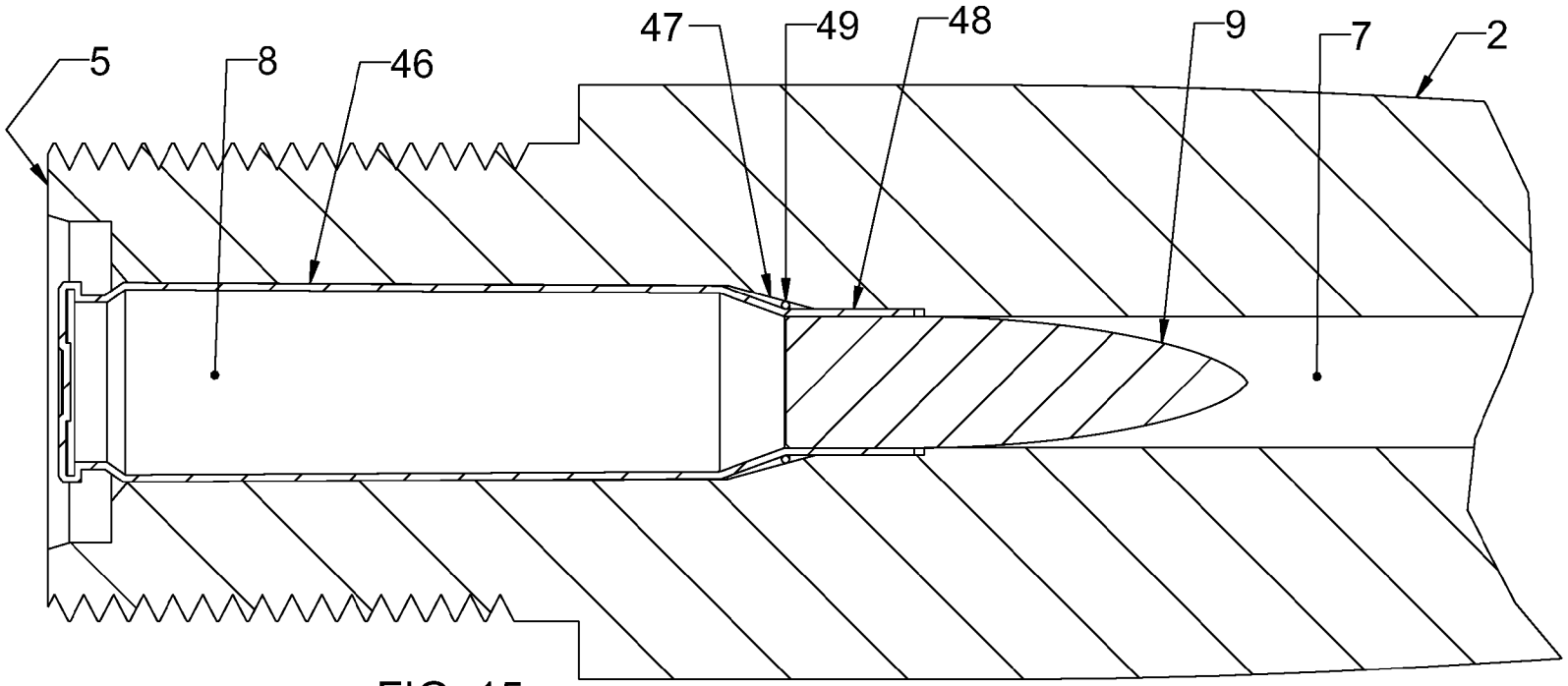
FIG. 15 is a partial side sectional view of a firearm barrel with one round of ammunition loaded in the chamber of the firearm's barrel.

FIG. 14 is a top view of the firearm that shows the cross sectional line 15-15 used in the partial cross section view of FIG. 15.

FIG. 15 is a partial cross-sectional view taken along the line 15-15 of FIG. 14. A round of ammunition 8 is shown loaded into the proximal end 5 of the barrel 2.

The ammunition 8 forms a tight seal at the several areas of contact 46, 47, and 48 of the firing chamber. As an aid, an o-ring 49 may be added over the ammunition 8 to help in creating a good vacuum seal at location 47. When vacuum is applied through the bullet passage 7, the small o-ring 49 is sucked toward surface 48 of the firing chamber helping to create a tight vacuum seal at this location.

While the above written description of my invention enables any person skilled in the art to which the invention pertains to make and use the invention and set forth the best mode contemplated for carrying out the invention, those of regular skill will be able to understand and appreciate the existence of variations, and equivalents of the specific embodiments, methods, and examples here shown. My invention should therefore not be limited by the above described embodiments, methods, and examples, but by all embodiments and methods within the scope and spirit of my invention.

What is claimed is:

1. A suppressor for a firearm, the firearm having a muzzle through which a round exits upon firing of the firearm, the suppressor comprising:

at least one vacuum chamber configured for mounting to the muzzle;

said vacuum chamber having a proximal end opening configured for connection to and for fluid communication with the muzzle;

said vacuum chamber having a distal end opening in fluid communication with said vacuum chamber;

a vacuum seal that seals said distal end opening of said vacuum chamber and that is configured to seal a vacuum in said vacuum chamber; and said vacuum seal being configured to be punctured by the round upon firing of the firearm.

2. The suppressor as set forth in claim 1, further comprising:

a housing;

said at least one vacuum chamber including a plurality of vacuum chambers, each of which being carried in said housing;

each of said plurality of vacuum chambers defining a passage configured to allow the round to pass therethrough upon firing of the firearm; and each of said passages being generally coaxial with respect to one another.

3. The suppressor as set forth in claim 1, wherein:

said vacuum chamber includes a vacuum chamber passage in fluid communication with said proximal end opening and said distal end opening;

said vacuum chamber passage being configured to allow the round to pass therethrough upon firing of the firearm; and said vacuum chamber passage extending substantially coaxially with the muzzle of the firearm.

4. The suppressor as set forth in claim 1, further comprising:

a vacuum connection port in fluid communication with said vacuum chamber; and a vacuum pump configured to be connected to said vacuum connection port, wherein said vacuum pump may create a vacuum in said vacuum chamber.

5. The suppressor as set forth in claim 1, wherein said vacuum seal is generally frustoconical in shape.

6. The suppressor as set forth in claim 1, wherein said vacuum seal is generally spherical in shape.

7. The suppressor as set forth in claim 1, wherein said vacuum seal is generally disc-shaped.

8. The suppressor as set forth in claim 1, further comprising an O-ring that encircles the round in the firearm and facilitates maintenance of said vacuum in said vacuum chamber.

9. A suppressor for a firearm, the firearm having a muzzle through which a round exits upon firing of the firearm, the suppressor comprising:

a housing having a proximal end opening configured for fluid communication with the muzzle and a distal end opening;

a plurality of vacuum chambers, each of which being carried in said housing;

each of said plurality of vacuum chambers defining a passage configured to allow the round to pass therethrough upon firing of the firearm;

each of said passages being generally coaxial with respect to one another and in fluid communication with said proximal opening and with said distal opening;

a vacuum seal that seals said distal end opening and that is configured to seal a vacuum in said plurality of vacuum chambers; and said vacuum seal configured to be punctured by the round upon firing of the firearm.

10. A suppressor for a firearm, the firearm having a muzzle through which a round exits upon firing of the firearm, the suppressor comprising:

a housing having a proximal end opening configured for fluid communication with the muzzle and a distal end opening;

a vacuum chamber carried in said housing;

said vacuum chamber defining a passage configured to allow the round to pass therethrough upon firing of the firearm;

said passage being in fluid communication with said proximal opening and with said distal opening;

a vacuum seal that seals said distal end opening and that is configured to seal a vacuum in said vacuum chamber; and said vacuum seal being configured to be punctured by the round upon firing of the firearm.

* * * * *